5/1/84 XR 4,445,798

United States Patent [19]

Munehiro

[11] 4,445,798

[45] May 1, 1984

[54] SERIAL PRINTER WITH A LINEAR MOTOR PRINTER CARRIAGE

[75] Inventor: Hidehiko Munehiro, Tokyo, Japan

[73] Assignee: Nippon Electric Co., Ltd., Tokyo, Japan

[21] Appl. No.: 235,273

[22] Filed: Feb. 17, 1981

[30] Foreign Application Priority Data

Feb. 15, 1980 [JP] Japan ..... 55-17626
Feb. 27, 1980 [JP] Japan ..... 55-23550

[51] Int. Cl.[3] ..... B41J 19/14; B41J 19/30; B41J 25/28

[52] U.S. Cl. ..... 400/320; 400/322; 310/12; 310/15; 318/135

[58] Field of Search ..... 400/322, 3, 337–338, 400/317, 320; 310/12–15, 17, 20, 23, 27; 318/135, 687, 14

[56] References Cited

U.S. PATENT DOCUMENTS

| | | | |
|---|---|---|---|
| 749,723 | 1/1904 | Dufur | 400/317 |
| 3,592,309 | 7/1971 | Craft et al. | 400/322 X |
| 3,740,628 | 6/1973 | Inagaki | 318/135 |
| 4,012,676 | 3/1977 | Giebler | 400/322 X |
| 4,151,447 | 4/1979 | von der Heide | 318/135 |
| 4,159,882 | 7/1979 | Sanders, Jr. et al. | 400/322 X |
| 4,293,235 | 10/1981 | Gomi | 400/322 |
| 4,318,038 | 3/1982 | Munehiro | 400/322 X |

*Primary Examiner*—Edgar S. Burr
*Assistant Examiner*—David A. Wiecking
*Attorney, Agent, or Firm*—Sughrue, Mion, Zinn, Macpeak & Seas

[57] ABSTRACT

A serial printer is provided with a moving coil type linear motor operated printer carriage, wherein the magnetic field produced by a magnetic circuit of the linear motor is greatest at the opposite ends of the print stroke. The areas of increased magnetic field allow the printer carriage to be quickly accelerated up to the uniform speed at which printing takes place, as well as the deceleration of the carriage as it approaches the end of the print stroke.

5 Claims, 9 Drawing Figures

SERIAL PRINTER WITH A LINEAR MOTOR PRINTER CARRIAGE

This invention relates to a serial printer with a linear motor printer carriage, and more particularly to a serial printer in which printing is achieved while the printer carriage slides at a uniform sliding speed.

As computers are propagated into the office automation field, printers of high speed, high printing-accuracy, light weight and low cost have been much in demand as output devices for printing letters, characters, symbols, graphic information, etc.

In printers such as dot printers and ink-jet printers, a print head mounted on a printer carriage is driven at a uniform sliding speed in a printing stroke, in which printing is achieved, and the printing speed depends upon the carriage sliding speed. A driving motor for the printer carriage is controlled such that a maximum current is applied thereto during the acceleration and deceleration periods in each printing stroke, i.e., for the periods of time when the printer carriage is positioned at the opposite ends, to provide the maximum output torque of the driving motor; and a small amount of current is applied so as to compensate for the lowering of the carriage sliding speed due to the printing operation and the sliding friction between the carriage and the guide rails. In a non-impact type serial printer such as an ink-jet printer, the lowering in the carriage sliding speed is dependent upon only the sliding friction.

In a conventional printing machine, a print head mounted on a printer carriage is slid on guide rails by a rotary motor through a cable connected to the carriage and wound around a multi-grooved pulley attached to the motor. Such a printing machine involves the problem of limited carriage positioning accuracy due to the elongation or contraction and the aging of the cable.

To solve this problem, a direct driving system has been proposed in which the printer carriage is driven by a linear motor. One example of conventional linear motors used for positioning the printer carriage is described in the copending patent application Ser. No. 93,556 now U.S. Pat. No. 4,318,038 "MOVING-COIL LINEAR MOTOR" by H. MUNEHIRO, the present inventor. In such a printing machine, the linear motor must be driven such that the print head mounted on the printer carriage can be stopped at any printing position and accelerated to, or decelerated from, a predetermined velocity. Therefore, the magnetic circuit of the linear motor has been designed to provide a large and uniform output drive force throughout the motor stroke. This makes the printer as a whole more expensive, bulky and heavy.

It is, therefore, an object of this invention to provide a serial printer having a linear motor printer carriage with a simplified magnetic circuit.

According to this invention, there is provided a serial printer for printing information on a document by a print head mounted on a linear motor printer carriage while the printer carriage slides at a uniform sliding speed throughout the printing stroke. The linear motor printer carriage comprises a magnetic circuit for providing a magnetic field at an air gap, the magnetic field being greater at both end portions in the printing stroke than that in the remaining portion, and a moving coil coupled to the print head, the moving coil being movable within said air gap in a direction perpendicular to the magnetic field.

Other features and advantages of this invention will be apparent from the following description of preferred embodiments of this invention taken in conjunction with the accompanying drawings, wherein.

Figure 1:
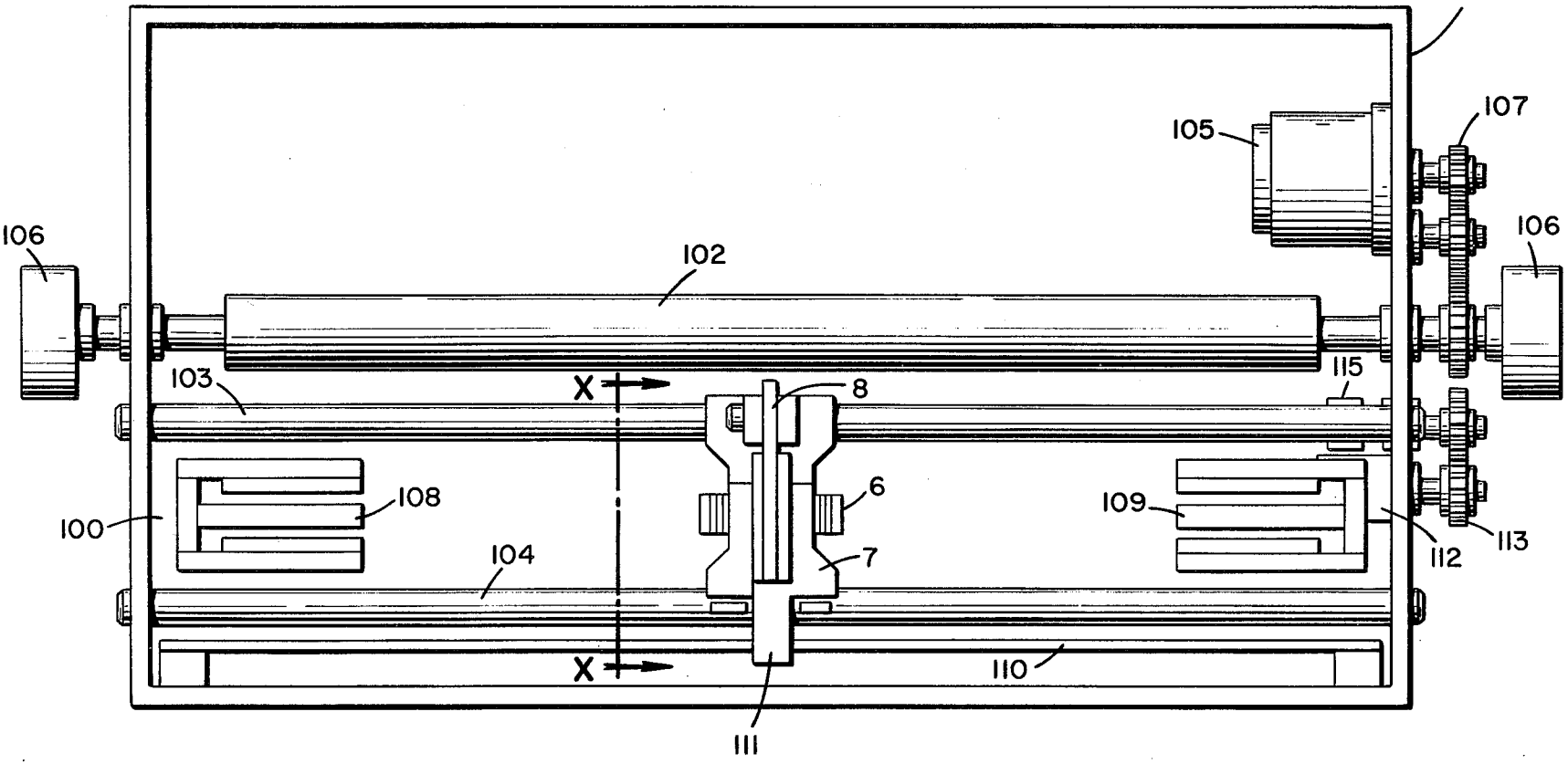
FIG. 1 is a plan view of a printing machine according to a first embodiment of this invention.
Figure 2:
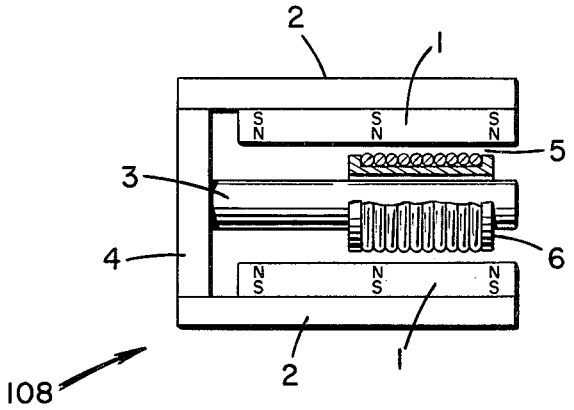
FIG. 2 is a plan view of a linear motor employed in the first embodiment.
Figure 3:
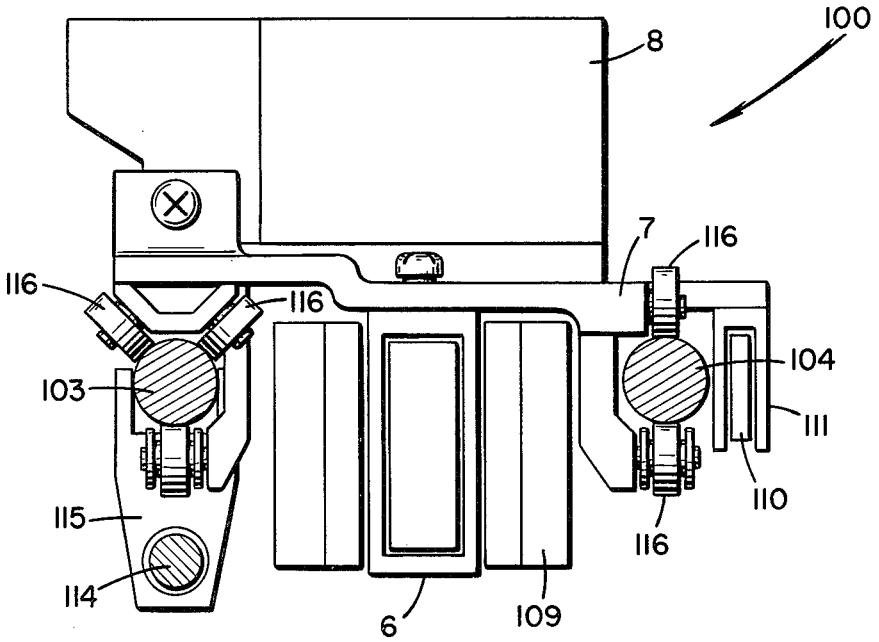
FIG. 3 is a cross-sectional view along the line X—X' in FIG. 1.

Referring to FIGS. 1, 2 and 3, the printing machine of a first embodiment of the invention comprises a frame 101, a printing head 8 such as a ink-jet print head mounted on a carriage assembly 7 sliding on guide rails 103 and 104, a platen 102 driven by a knob 106 or a paper feed motor 105 through gear train 107, and a linear motor 100 for causing the linear movement of the carriage assembly 7. The moving-coil linear motor 100 comprises two sets of permanent magnet slabs 1 magnetized in the direction of their thicknesses, two sets of flat yokes 2 parallel to each other, holding the permanent magnet slabs 1 glued or otherwise attached to one face thereof, a flat center yoke 3 so arranged as to face said permanent magnet slabs 1, and side yokes 4 fastening the flat yokes 2 and the center yoke 3. The permanent magnet slabs 1, the flat yokes 2, the center yoke 3 and the side yokes 4 constitute a magnetic circuit 108 or 109 for generating a magnetic flux of uniform density at air gaps 5 between the permanent magnet slabs 1 and the center yoke 3. The magnetic circuits 108 and 109 are provided only at the end portions of the printing stroke, as shown in FIG. 1.

The linear motor 100 further comprises a moving coil 6 capable of moving in the air gaps 5 in a direction perpendicular to the magnetic flux, and a position snesor 111 for detecting the position of the carriage 7 in the printing stroke from a position scale 110. The printer carriage 7 and the position sensor 111 are coupled to the moving coil 6, and slide on the guide rails 103 and 104 with the aid of guide rollers 116, as shown in FIG. 3. Therefore, the sliding friction between the printer carriage 7 and the guide rails 103 and 104 is negligibly small, and the carriage sliding speed on the guide rails 103 and 104 is substantially uniform in the printing stroke.

The moving coil 6 is accelerated at the air gap 5 in the magnetic circuit 108 positioned on the left-hand side of the printer by the reciprocal action between the magnetic flux and an electric current applied to the coil 6, and then slides toward the right at a substantially uniform sliding speed. When the moving coil 6 enters the air gap 5 of the magnetic circuit 109 positioned on the right-hand side of the printer, it is decelerated and inversely accelerated (i.e., reversed) by the reciprocal action in the magnetic circuit 109, to thereby slide toward the left at a substantially uniform speed. During sliding at the substantially uniform speed, information is printed on a paper provided on the platen 102 by the print head 8 in response to a carriage position detecting signal emitted by the position sensor 111.

The printing machine further comprises a slider 115 driven by a feed screw 114 coupled to a motor 112 through a gear train 113. When the printer carriage 7 is stopped at any position in the printing stroke except for the areas of the magnetic circuits 108 and 109, it is driven by the slider 115 to slide toward the left.

Figure 4:
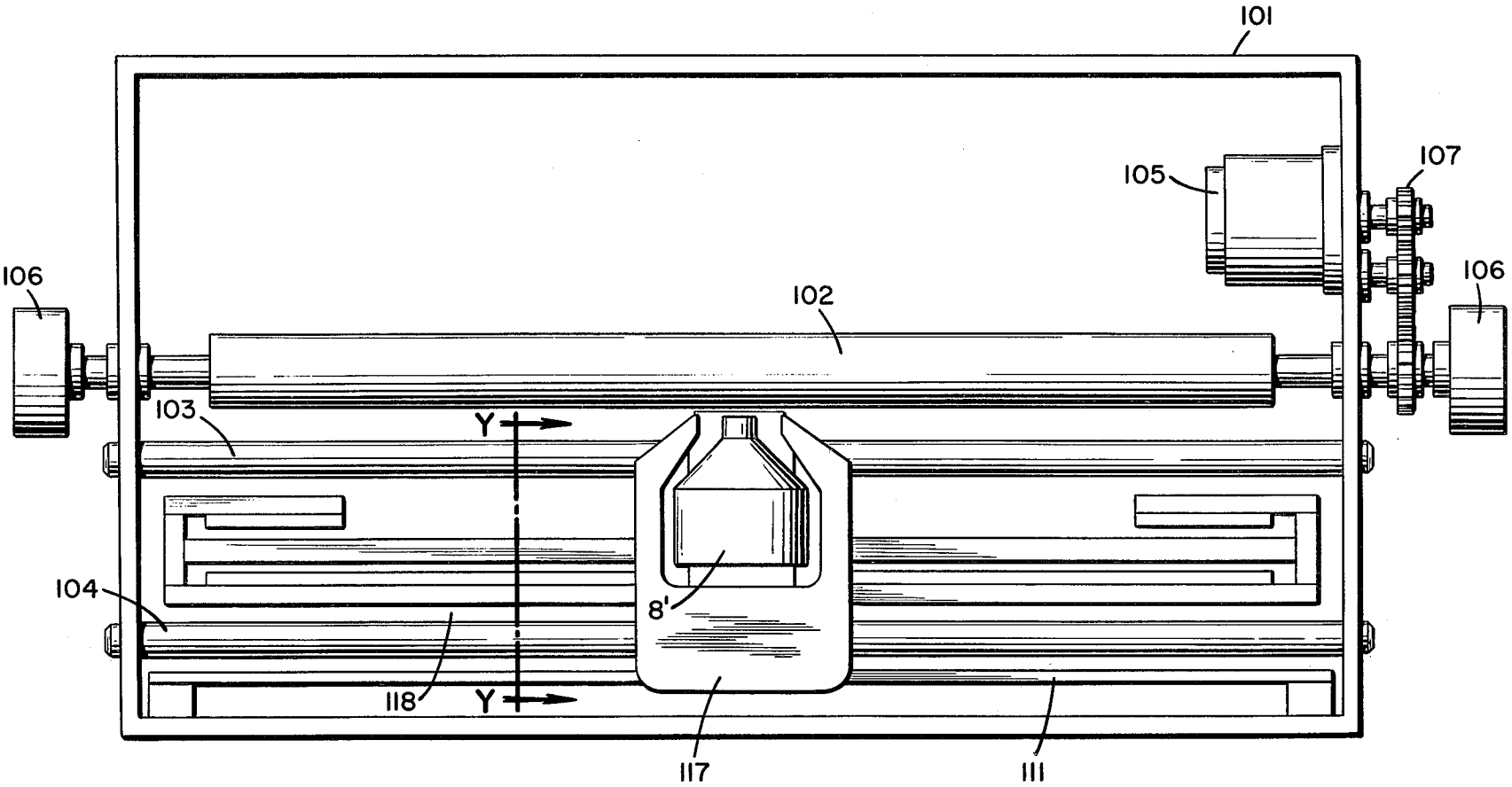
FIG. 4 is a plan view of a printing machine according to a second embodiment of this invention.
Figure 5:
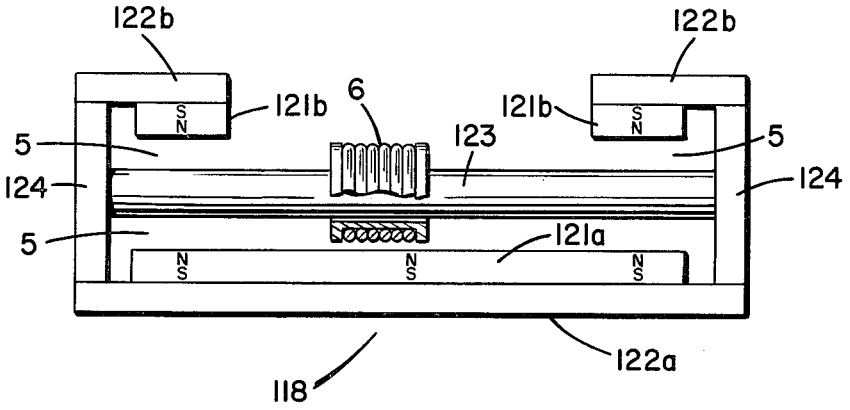
FIG. 5 is a plan view of a linear motor employed in the second embodiment.
Figure 6:
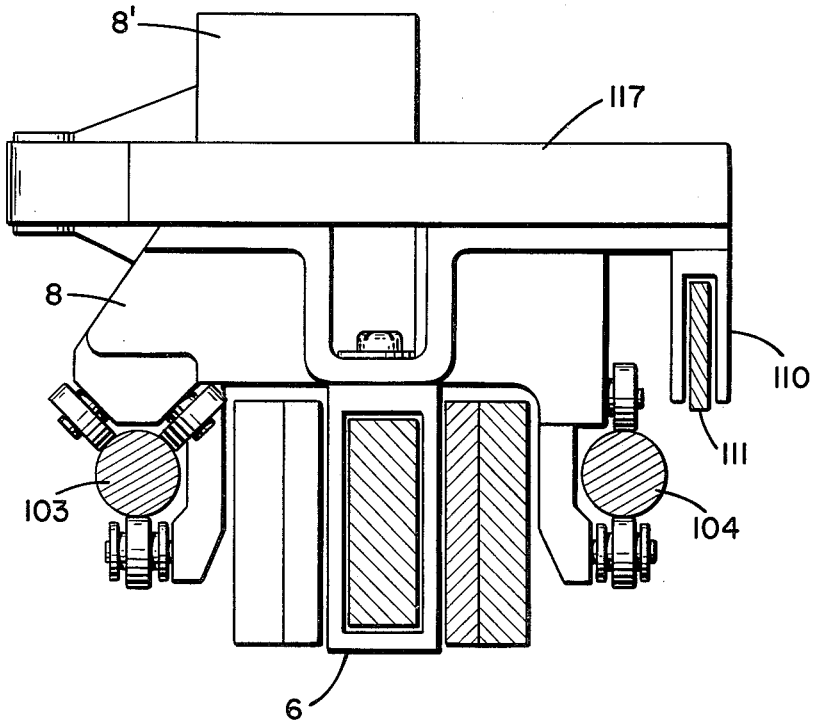
FIG. 6 is a cross-sectional view along the line Y—Y' in FIG. 4.

Referring to FIGS. 4, 5 and 6, the second embodiment comprises a print head 8' such as a dot type print head, an inked-ribbon cartridge 117, and a magnetic circuit 118 (FIG. 5). Other structural parts are identical to those in the first embodiment except that the second embodiment does not comprise means for returning the carriage 7 to the home position by force.

The magnetic circuit 118 comprises a first flat yoke 122*a* having a length longer than the motor stroke (printing stroke), a first permanent magnet slab 121*a* magnetized in the direction of its thickness and attached to the first flat yoke 122*a*, two second flat yokes 122*b* provided at both end portions of the motor stroke, and two second permanent magnet slabs 121*b* magnetized in the direction of their thicknesses and attached to the second flat yokes 122*b*. The magnetic circuit 118 further comprises a flat center yoke 123 and side yokes 124.

In the magnetic circuit 118, the force applied to the moving coil 6 is greater at both end portions (in which the second permanent magnet slabs 121*b* and the second flat yokes 122*b* are provided) than that at the remaining portions. Therefore, the moving coil 6 accelerated at the end portions can slide throughout the remaining portion of the motor stroke substantially uniform sliding speed without reducing the sliding speed even when the print head 8' is of an impact type.

Figure 7:
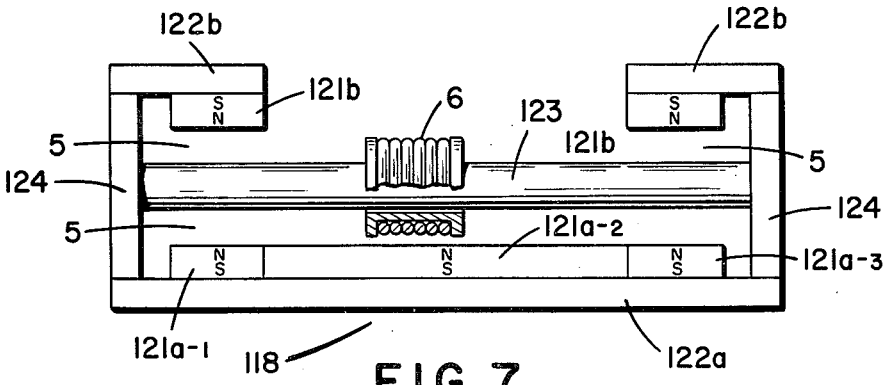
FIGS. 7, 8 and 9 show modifications of the magnetic circuit employed in the second embodiment.
Figure 8:
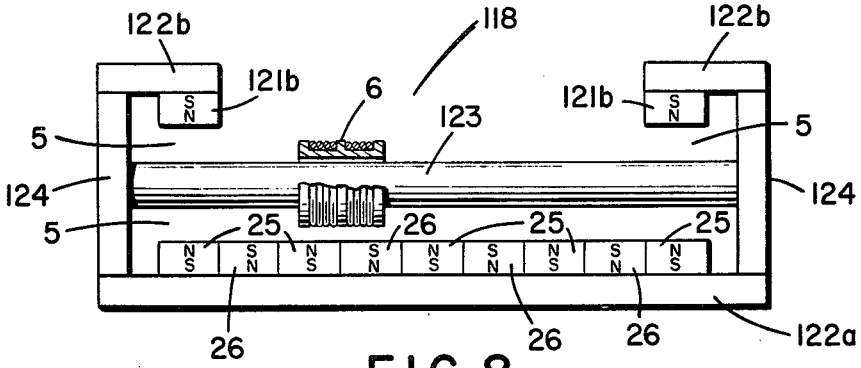
Figure 9:
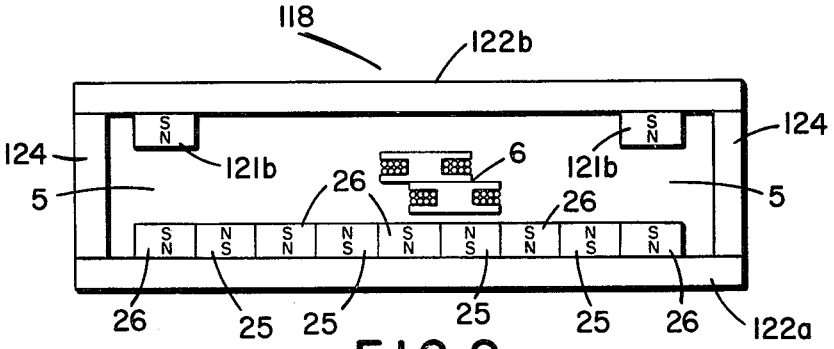

As described above, in this invention, the force factor, i.e., the output drive force is greater at both end portions of the motor stroke than that at the remaining portion in which the moving coil slides at a uniform speed. Modifications of the magnetic circuit 118 for providing such a force factor characteristic are shown in FIGS. 7, 8 and 9. In FIG. 7, the first permanent magnet slab 121*a* is divided into three portions 121*a*-1, 121*a*-2 and 121*a*-3. The end portions 121*a*-1 and 121*a*-3 are composed of a high-efficiency magnet such as a rare earth magnet and the center portion 121*a*-2 is composed of a lower-efficiency magnet such as a ferrite magnet.

The second permanent magnets 121*b* are also composed of the high-efficiency magnet.

In FIGS. 8 and 9, the first permanent magnet 121*a* is arranged so that the magnetic circuit 118 provides a plurality of magnetic fields of polarities alternating at equal intervals. The moving coil 6 has two coils disposed side by side. Such a linear motor is described in detail in the above mentioned U.S. patent application Ser. No. 93,556, now U.S. Pat. No. 4,318,038.

What is claimed is:

1. A serial printer comprising:

a printer carriage having a non-impact type print head mounted thereon, guide means for guiding lateral reciprocation of said carriage, roller means provided on said carriage for reducing sliding friction between said carriage and said guide means, and a linear motor including a magnetic circuit for creating a magnetic field at an air gap, and a moving coil movable within said air gap in a direction perpendicular to said magnetic field, said moving coil being secured to said carriage, said magnetic circuit being provided only at both end portions of said carriage reciprocation, and said carriage sliding on said guide means at a substantially uniform sliding speed over a printing stroke.

2. The printer as claimed in claim 1 further comprising:

a position scale disposed parallel to said guide means, and a detecting means mounted on said carriage for detecting the carriage position on said guide means from said scale.

3. The printer as claimed in claim 1, further comprising driving means for driving said printing head toward one end of said print stroke, said driving means being operable at least when said print head has stopped at a position intermediate the ends of the print stroke.

4. The printer as claimed in claim 1, wherein said magnetic circuit is disposed upon yoke means having a length longer than said printing stroke.

5. The printer as claimed in claim 1, further comprising roller means fixed to said carriage and mechanically coupled with said guide means.

* * * * *